US007230176B2

(12) United States Patent
Kosonen

(10) Patent No.: US 7,230,176 B2
(45) Date of Patent: Jun. 12, 2007

(54) METHOD AND APPARATUS TO MODIFY PITCH ESTIMATION FUNCTION IN ACOUSTIC SIGNAL MUSICAL NOTE PITCH EXTRACTION

(75) Inventor: Timo Antero Kosonen, Tampere (FI)

(73) Assignee: Nokia Corporation, Espoo (FI)

( * ) Notice: Subject to any disclaimer, the term of this patent is extended or adjusted under 35 U.S.C. 154(b) by 231 days.

(21) Appl. No.: 10/950,325

(22) Filed: Sep. 24, 2004

(65) Prior Publication Data

US 2006/0065107 A1 Mar. 30, 2006

(51) Int. Cl.
*A63H 5/00* (2006.01)
*G04B 13/00* (2006.01)
*G10H 7/00* (2006.01)

(52) U.S. Cl. ..... 84/609; 84/600; 84/601; 84/616; 84/649; 84/654

(58) Field of Classification Search ..... None
See application file for complete search history.

(56) References Cited

U.S. PATENT DOCUMENTS

| | | | | |
|---|---|---|---|---|
| 5,300,725 | A | 4/1994 | Manabe | 84/609 |
| 5,602,960 | A * | 2/1997 | Hon et al. | 704/207 |
| 5,619,004 | A * | 4/1997 | Dame | 84/616 |
| 5,799,276 | A * | 8/1998 | Komissarchik et al. | 704/251 |
| 5,977,468 | A | 11/1999 | Fujii | 84/609 |
| 6,342,666 | B1 | 1/2002 | Shutoh | 84/645 |
| 2004/0154460 | A1 | 8/2004 | Virolainen et al. | 84/645 |
| 2004/0159219 | A1 | 8/2004 | Holm et al. | 84/645 |
| 2005/0021581 | A1* | 1/2005 | Lin | 708/426 |
| 2005/0143983 | A1* | 6/2005 | Chang et al. | 704/218 |

OTHER PUBLICATIONS

MMidi: The MBONE Midi Tool, "Synchronizing Digital Music in a Multicast Network", 1996 Multimedia Networks Group, 3 pages.
"RTP: A Transport Protocol for Real-Time Applications", H. Schulzrinne et al., Jan. 1996, pp. 1-71, http://www.ietf.org/rfc/rfc1889.txt.
"RTP Payload Formats to Enable Multiple Selective Retransmissions", A. Miyazaki et al., May 2002, pp. 1-24, http://search.ietf.org/internet-drafts/draft-ietf-avt-rtp-selret-03.txt.
"RTP retransmission framework", David Leon et al., Nov. 2001, pp. 1-7, http://search.ietf.org/internet-drafts/draft-leon-rtp-retransmission-01.txt.

(Continued)

*Primary Examiner*—Marlon Fletcher
(74) *Attorney, Agent, or Firm*—Harrington & Smith, PC

(57) ABSTRACT

In one aspect thereof this invention provides a method to estimate pitch in an acoustic signal. The method includes initializing a function $f_t$ and a time t, where t=0, $x'_0=f_0(F_0)$, $x'_0$ is a pitch estimate at time zero and $F_0$ is a frequency of the acoustic signal at time zero; determining at least one pitch estimate using the function $x'_t=f_t(F_t)$ by an iterative process of creating $f_{t+1}(F_{t+1})$ based at least partly on pitch estimates $x'_t$, $x'_{t-1}$, $x'_{t-2}$, $x'_{t-3}$, . . . , and functions $f_t(F_t)$, $f_{t-1}(F_{t-1})$, $f_{t-2}(F_{t-2})$, $f_{t-3}(F_{t-3})$ . . . and incrementing t; and calculating at least one final pitch estimate. Embodiments of this invention can be applied to pitch extraction with various different input acoustic signal characteristics, such as just intonation, pitch shift in the frequency domain, and non-12-step-equal-temperament tuning.

30 Claims, 2 Drawing Sheets

OTHER PUBLICATIONS

"Extended RTP Profile for RTCP-based Feedback (RTP/AVPF)", Stephan Wenger et al., Nov. 21, 2001, pp. 1-38, http://search.ietf.org/internet-drafts/draft-ietf-avt-rtcp-feedback-01.txt.

"Scalable Polyphony MIDI Device 5-24 Note Profile for 3GPP", The MIDI Manufacturers Association, Nov. 29, 2001, pp. 1-16.

"Scalable Polyphony MIDI Specification", The MIDI Manufacturers Association, Nov. 29, 2001, pp. 1-14.

"A Case for Network Musical Performance", John Lazzaro et al., ACM 1-58113-370, 2001, 10 pages.

"The MIDI Wire Protocol Packetization (MWPP)", John Lazzaro et al, Feb. 28, 2002, http://www.ietf.org/internet-draft-ietf-avt-mwpp-midi-rtp-02.txt.

"Probabilistic Modelling of Note Events in the Transcription of Monophonic Melodies", Matti Ryynänen, Tampere University of Technology, Feb. 11, 2004, pp. 1-80.

"Multiple fundamental frequency estimation based on harmonicity and spectral smoothness", A. P. Klapuri, IEEE Trans. Speech and Audio Proc. 11(6), 2003, pp. 804-816.

"Analysis of the Meter of Acoustic Musical Signals", Anssi P. Klapuri et al., IEEE Trans. Speech and Audio Processing, 2004, pp. 1-21.

"Melody Description and Extraction in the Context of Music Content Processing", Emilia Gomez, et al., May 9, 2002, 22 pages.

"Signal Processing Methods for the Automatic Transcription of Music", Anssi Kiapuri, Tampere University of Technology, 2004, 113 pages plus attachments.

* cited by examiner

METHOD AND APPARATUS TO MODIFY PITCH ESTIMATION FUNCTION IN ACOUSTIC SIGNAL MUSICAL NOTE PITCH EXTRACTION

TECHNICAL FIELD

The presently preferred embodiments of this invention relate generally to methods and apparatus for performing music transcription and, more specifically, relate to pitch estimation and extraction techniques for use during an automatic music transcription procedure.

BACKGROUND

Pitch perception plays an important role in human hearing and in the understanding of sounds. In an acoustic environment a human listener is capable of perceiving the pitches of several sounds simultaneously, and can use the pitch to separate sounds in a mixture of sounds. In general, a sound can be said to have a certain pitch if it can be reliably matched by adjusting the frequency of a sine wave of arbitrary amplitude.

Music transcription as employed herein may be considered to be an automatic process that analyzes a music signal so as to record the parameters of the sounds that occur in the music signal. Generally in music transcription, one attempts to find parameters that constitute music from an acoustic signal that contains the music. These parameters may include, for example, the pitches of notes, the rhythm and loudness.

Reference can be made, for example, to Anssi P. Klapuri, "Signal Processing Methods for the Automatic Transcription of Music", Thesis for degree of Doctor of Technology, Tampere University of Technology, Tampere FI 2004 (ISBN 952-15-1147-8, ISSN 1459-2045), and to the six publications appended thereto.

Western music generally assumes equal temperament (i.e., equal tuning), in which the ratio of the frequencies of successive semi-tones (notes that are one half step apart) is a constant. For example, and referring to Klapuri, A. P., "Multiple Fundamental Frequency Estimation Based on Harmonicity and Spectral Smoothness", IEEE Trans. On Speech and Audio Processing, Vol. 11, No. 6,804-816, November 2003, it is known that notes can be arranged on a logarithmic scale where the fundamental frequency $F_k$ of a note k is $F_k=440\times2^{(k/12)}$ Hz. In this system, a' (440 Hz) receives the value k=0. The notes below a' (in pitch) receive negative values while the notes above a' receive positive values. In this system k can be converted to a MIDI (Musical Instrument Digital Interface) note number by adding the value 69. General reference with regard to MIDI can be made to "MIDI 1.0 Detailed Specification", The MIDI Manufacturers Association, Los Angeles, Calif.

A problem that can arise during pitch extraction is illustrated in the following examples that demonstrate an increase in the probability for an error to occur in pitch extraction when attempting to locate the best pitch estimates for sung, played, or whistled notes. The following examples assume that the relationship $F_k=440\times2^{(k/12)}$ Hz is unmodified.

When a skilled vocalist sings a cappella (without an accompaniment), the vocalist is likely to use just intonation as a basis for the scale. Just intonation uses a scale where simple harmonic relations are favored (reference in regard to simple harmonic relations can be made to Klapuri, A. P., "Multipitch Estimation and Sound Separation by the Spectral Smoothness Principle", Proc. IEEE Int. Conf. on Acoustics, Speech, and Signal Processing, Salt Lake City, Utah 2001). In just intonation, ratios m/n (where m and n are integers greater than zero) between the frequencies in each note interval of the scale are adjusted so that m and n are small:

$$F=(m/n)F_r, \text{ where } F_r \text{ is the frequency of the root note of the key.} \quad (1)$$

In addition, an a cappella vocalist may loose the sense of a key and sing an interval so that m and n in the ratio of the frequencies of consecutive notes are small:

$$F_{k+1}=(m/n)F_k. \quad (2)$$

There may also be a constant error in tuning, where an a cappella vocalist may use his/her own temperament by singing constantly out of tune.

An additional problem can arise when music is composed to utilize a tuning other than equal temperament, e.g., as typically occurs in non-Western music.

Ryynänen, M., in "Probabilistic Modelling of Note Events in the Transcription of Monophonic Melodies", Master of Science Thesis, Tampere University of Technology, 2004, has proposed an algorithm for the tuning of pitch estimates for pitch extraction in the automatic transcription of music. The algorithm initializes and updates a specific histogram mass center $c_t$ based on an initial pitch estimate $x'_t$ for an extracted frequency, where $x'_t$ is calculated as:

$$x'_t=69+12\log_2(F_t/440). \quad (3)$$

A final pitch estimate is made as: $x_t=x'_t+c_t$.

The foregoing algorithm is based on equal temperament. However, there are some applications that are not well served by an algorithm based on equal temperament, such as when it is desired to accurately extract pitch from audio signals that contain singing or whistling, or from audio signals that represent non-Western music or other music that does not exhibit equal temperament.

SUMMARY OF THE PREFERRED EMBODIMENTS

The foregoing and other problems are overcome, and other advantages are realized, in accordance with the presently preferred embodiments of this invention.

In one aspect thereof this invention provides a method to estimate pitch in an acoustic signal, and in another aspect thereof a computer-readable storage medium that stores a computer program for causing the computer to estimate pitch in an acoustic signal. The method, and the operations performed by the computer program, include initializing a function $f_t$ and a time t, where t=0, $x'_0=f_0(F_0)$, $x'_0$ is a pitch estimate at time zero and $F_0$ is a frequency of the acoustic signal at time zero; determining at least one pitch estimate using the function $x'_t=f_t(F_t)$ by an iterative process of creating $f_{t+1}(F_{t+1})$ based at least partly on pitch estimates $x'_t$, $x'_{t-1}$, $x'_{t-2}$, $x'_{t-3}$. . . , and functions $f_t(F_t)$, $f_{t-1}(F_{t-1})$, $f_{t-2}(F_{t-2})$, $f_{t-3}(F_{t-3})$ . . . and incrementing t; and calculating at least one final pitch estimate.

In another aspect thereof this invention provides a system that comprises means for receiving data representing an acoustic signal and processing means to process the received data to estimate a pitch of the acoustic signal. The processing means comprises means for initializing a function $f_t$ and a time t, where t=0, $x'_0=f_0(F_0)$, $x'_0$ is a pitch estimate at time zero and $F_0$ is a frequency of the acoustic signal at time zero; means for determining at least one pitch estimate using the function $x'_t=f_t(F_t)$ by an iterative process of creating $f_{t+1}$, $(F_{t+1})$ based at least partly on pitch estimates $x'_t$, $x'_{t-1}$, $x'_{t-2}$, $x'_{t-3}$, . . . , and functions $f_t(F_t)$, $f_{t-1}(F_{t-1})$, $f_{t-2}(F_{t-2})$, $f_{t-3}(F_{t-3})$ . . . and incrementing t; and means for calculating at least one final pitch estimate.

In one non-limiting example of embodiments of this invention the receiving means comprises a receiver means having an input coupled to a wired and/or a wireless data communications network. In another non-limiting example of embodiments of this invention the receiving means comprises an acoustic transducer means and an analog to digital conversion means for converting an acoustic signal to data that represents the acoustic signal. In another non-limiting example of embodiments of this invention the acoustic signal comprises a person's voice. Further in accordance with this further non-limiting example of embodiments of this invention the system comprises a telephone, and the processor means uses at least one final pitch estimate for generating a ringing tone.

BRIEF DESCRIPTION OF THE DRAWINGS

The foregoing and other aspects of the presently preferred embodiments of this invention are made more evident in the following Detailed Description of the Preferred Embodiments, when read in conjunction with the attached Drawing Figures, wherein.

DETAILED DESCRIPTION OF THE PREFERRED EMBODIMENTS

Figure 1:
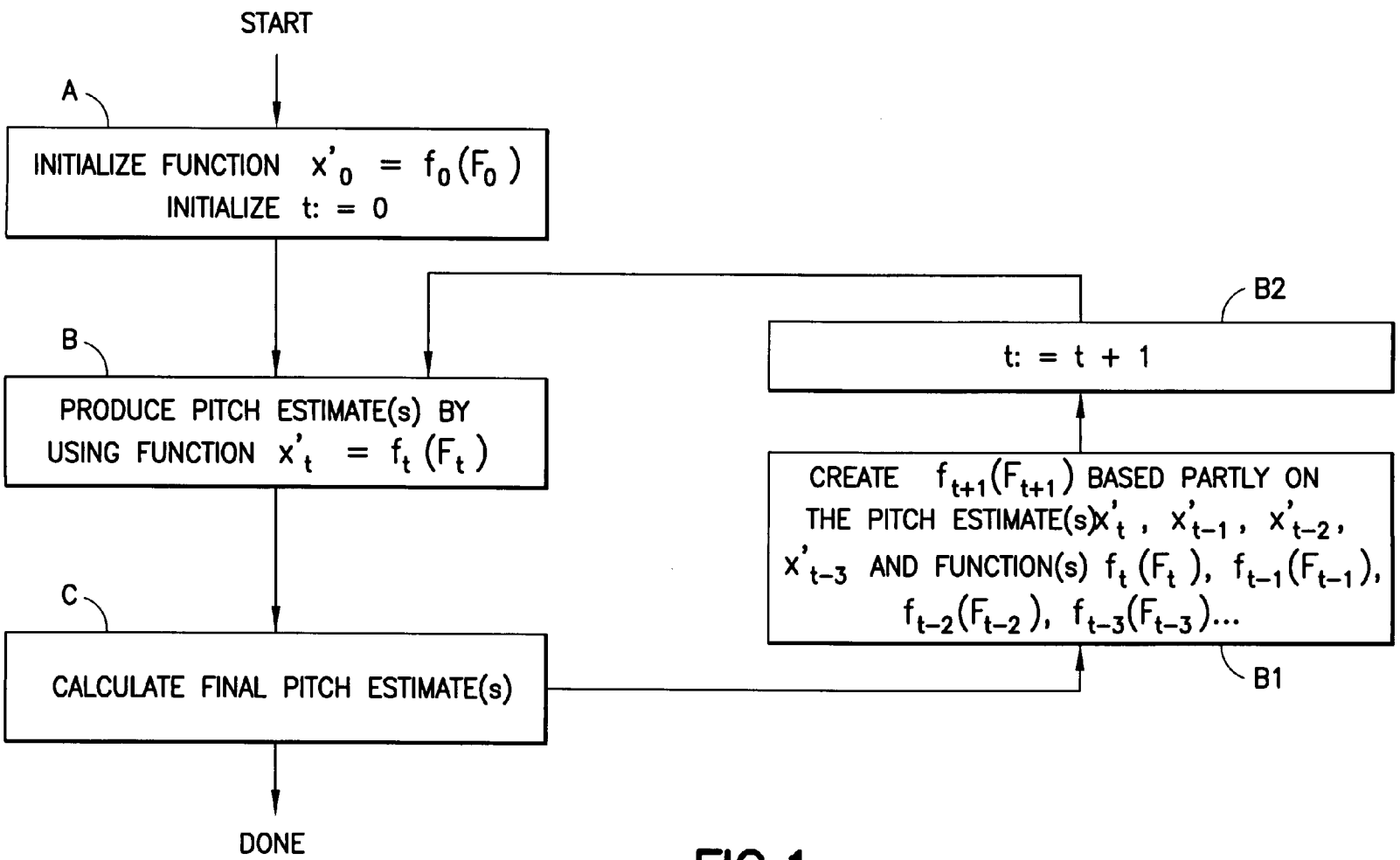
FIG. 1 is a logic flow diagram that illustrates a method in accordance with embodiments of this invention.

The preferred embodiments of this invention modify the pitch estimation function $x'_t=f(F_t)$ so that relationships other than equal temperament are made possible between $F_t$ and $x'_t$. A method for performing pitch estimation in accordance with embodiments of this invention is shown in FIG. 1, and is described below. The method may operate with stored audio samples, or may operate in real time or substantially real time.

Figure 2:
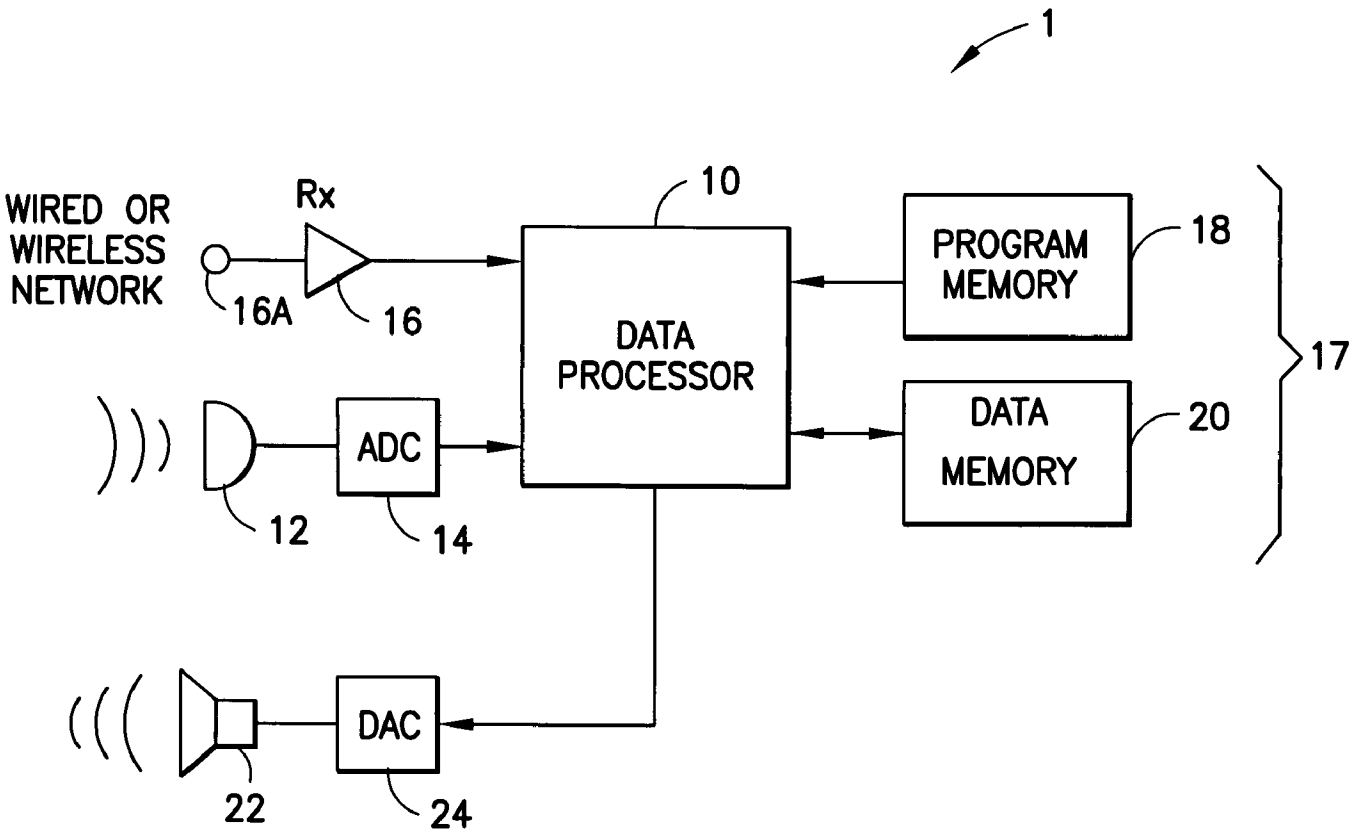
FIG. 2 is a block diagram of an exemplary system for implementing the method shown in FIG. 1.

FIG. 2 is a block diagram of an exemplary system 1 for implementing the method shown in FIG. 1. The system 1 includes a data processor 10 that is arranged for receiving a digital representation of an acoustic signal, such as an audio signal, that is assumed to contain acoustic information, such as music and/or voice and/or other sound(s) of interest. To this end there may be an acoustic signal input transducer 12, such as a microphone, having an output coupled to an analog to digital converter (ADC) 14. The output of the ADC 14 is coupled to an input of the data processor 10. In lieu of the transducer 12 and ADC 14, or in addition thereto, there may be a receiver (Rx) 16 having an input coupled to a wired or a wireless network 16A for receiving digital data that represents an acoustic signal. The wired network can include any suitable personal, local and/or wide area data communications network, including the Internet, and the wireless network can include a cellular network, or a wireless LAN (WLAN), or personal area network (PAN), or a short range RF or IR network such as a Bluetooth™ network, or any suitable wireless network. The network 16A may also comprise a combination of the wired and wireless networks, such as a cellular network that provides access to the Internet via a cellular network operator. Whatever the network 16A type, the Rx 16 is assumed to be an appropriate receiver type (e.g., an RF receiver/amplifier, or an optical receiver/amplifier, or an input buffer/amplifier for coupling to a copper wire) for the network 16A.

The data processor 10 is further coupled to at least one memory 17, shown for convenience in FIG. 2 as a program memory 18 and a data memory 20. The program memory 18 is assumed to contain program instructions for controlling operation of the data processor 10, including instructions for implementing the method shown in FIG. 1, and various other embodiments of and variations on the method shown in FIG. 1. The data memory 20 may store received digital data that represents an acoustic signal, whether received through the transducer 12 and ADC 14, or through the Rx 16, and may also store the results of the processing of the received acoustic signal samples.

Also shown in FIG. 2 is an optional output acoustic transducer 22 having an input coupled to an output of a digital to analog converter (DAC) 24 that receives digital data from the data processor 10. As a non-limiting example, the system 1 may represent a cellular telephone, the input acoustic signal can represent a user's voice (spoken, sung or whistled), and the output acoustic signal can represent a ringing "tone" that is played by the data processor 10 to announce to the user that an incoming call is being received through the Rx 16. In this case the ringing tone may be generated from an audio data file stored in the memory 17, where the audio data file is created at least partially through the use of the method of FIG. 1 as applied to processing the input acoustic signal that represents the user's voice.

In general, the various embodiments of the system 1 can include, but are not limited to, cellular telephones, personal digital assistants (PDAs) having audio functionality and optionally wired or wireless communication capabilities, portable or desktop computers having audio functionality and optionally wired or wireless communication capabilities, image capture devices such as digital cameras having audio functionality and optionally wired or wireless communication capabilities, gaming devices having audio functionality and optionally wired or wireless communication capabilities, music storage and playback appliances optionally having wired or wireless communication capabilities, Internet appliances permitting wired or wireless Internet access and browsing and having audio functionality, as well as portable and generally non-portable units or terminals that incorporate combinations of such functions.

Returning now to FIG. 1, the method executed by the data processor 10 functions so as to initialize a function $f_t$ and initialize a time t at block A; produce a pitch estimate or pitch estimates from samples of an acoustic signal of interest using the function $x'_t=f_t(F_t)$ at block B; and calculate a final pitch estimate or estimates at block C.

The operation of block B is preferably an iterative recursion, where at block $B_1$ the method creates $f_{t+1}(F_{t+1},)$ based at least partly on the pitch estimate(s) $x'_t$, $x'_{t-1}$, $x'_{t-2}$, $x'_{t-3}$, . . . , and function(s) $f_t(F_t)$, $f_{t-1}(F_{t-1})$, $f_{t-2}(F_{t-2})$, $f_{t-3}(F_{t-3})$ . . . ; and at block $B_2$ the method increments t.

The operation of block C, i.e., calculating the final pitch estimates, may involve calculating the final pitch estimate $(x_t)$ of a single note from multiple pitch estimates $(x_{t,i})$ that have been produced for the same note. In a related sense, re-entering the recursion B1, B2 from block C is especially beneficial in the case of a loss of a sense of key, as described in further detail below. In this case, the final pitch estimate (which depends on all $x_{t,i}$) should be determined for a note before the recursion may continue for the next note (with a slightly or clearly modified key).

It is noted that the operation of block C, i.e., calculating the final pitch estimates, may also include a shifting operation as in Ryynänen, discussed in further detail below, when adding $c_t$ to the result of the pitch estimation function.

It should be appreciated that the various blocks shown in FIG. 1 may also represent hardware blocks capable of performing the indicated function(s), that are interconnected as shown to permit recursion and signal flow from the input (start) to the output (done).

The embodiments of the invention can also be implemented using a combination of hardware blocks and software functions. Thus, the embodiments of this invention can be implemented using various different means and mechanisms.

Discussing the presently preferred embodiments of the method of FIG. 1 now in further detail, let $x'_t=f(F_t)$ be represented by:

$$x'_t=m+s*\log_2(F_t/F_b); \quad (4)$$

where s defines the number of notes in an octave, and $F_b$ is a reference frequency.

For the case of just intonation, and if the key of the music is known, one may set s=12, m=the MIDI number of the root note in the key, and $F_b=440\times2^{((m-69)/12)}$ Hz. One may then map the ratio $F_t/F_b$ to an adjusted ratio $R_t$ according to the following Table 1:

| $F_t/F_b$ | $R_t$ |
|---|---|
| . . . | . . . |
| $2^{(-1)}\times 9/5$ | $2^{(-2)/12}$ |
| $2^{(-1)}\times 15/8$ | $2^{(-1)/12}$ |
| $2^0\times 1$ | $2^{0/12}$ |
| $2^0\times 16/15$ | $2^{1/12}$ |
| $2^0\times 9/8$ | $2^{2/12}$ |
| $2^0\times 6/5$ | $2^{3/12}$ |
| $2^0\times 5/4$ | $2^{4/12}$ |
| $2^0\times 4/3$ | $2^{5/12}$ |
| $2^0\times 45/32$ | $2^{6/12}$ |
| $2^0\times 3/2$ | $2^{7/12}$ |
| $2^0\times 8/5$ | $2^{8/12}$ |
| $2^0\times 5/3$ | $2^{9/12}$ |
| $2^0\times 9/5$ | $2^{10/12}$ |
| $2^0\times 15/8$ | $2^{11/12}$ |
| $2^1\times 1$ | $2^{12/12}$ |
| $2^1\times 16/15$ | $2^{13/12}$ |
| $2^1\times 9/8$ | $2^{14/12}$ |
| $2^1\times 6/5$ | $2^{15/12}$ |
| $2^1\times 5/4$ | $2^{16/12}$ |
| $2^1\times 4/3$ | $2^{17/12}$ |
| . . . | . . . |

This mapping may be implemented with a continuous function or with multiple functions. The points between the values presented in the foregoing Table 1 may be estimated with a linear method or with a non-linear method. In practice, Table 1 may be permanently stored in the program memory 18, or it may be generated in the data memory 20 of FIG. 2. Next, one may compute the initial pitch estimate for the extracted frequency $F_t$ by using $x'_t=m+s*\log_2(R_t)$.

The embodiments of this invention also accommodate the case of the loss of a sense of key in just intonation (changing the reference key) by, after multiple final pitch estimates $x_{t,i}$ of the first note are calculated (including the special case when simply $x_t=x'_t$), one may set $m=x_t$(where $x_t$ depends on all $x_{t,i}$) and modify $F_b$ to be the corresponding frequency. Then, the method in FIG. 1 can continue to be iterated, and the method maps the ratio $F_t/F_b$ to an adjusted ratio $R_t$ for each note according to Table 1. One may calculate $x'_t=m+s*\log_2(R_t)$ to obtain each initial pitch estimate during the iterations.

The embodiments of this invention also accommodate the case of the constant error in tuning, as one may use $x'_t=m+s*\log_2(R_t)$, where s=12 and $R_t=(F_t+(\text{delta}))/F_b$. This approach is particularly useful if the vocalist or instrument has a constant error (delta), or shift in pitch, in the frequency domain.

One may use $x'_t=m+s*\log_2(F_t/F_b)$, where s=(alpha)*12, where the value of (alpha) defines by how much the scale is contracted or expanded. This can be useful, for example, if a vocalist sings low notes in tune but high notes out of tune. In this case, the references m and $F_b$ are selected to be from the range of pitch where the vocalist sings in tune. Here the function $x'_t=f(F_t)$ may contain multiple sub-functions, of which one is chosen based on a certain condition, for example, $F_t>200$ Hz.

The embodiments of this invention also accommodate the case of non-Western musical tuning and non-traditional tuning. In this case one may use $x'_t=s*\log_2(R_t)$, where $R_t$ depends on $F_t$ and $F_b$, and where s defines the number of steps in one octave. $R_t$ may be simply $R_t=F_t/F_b$ (equal tuning) or some other mapping (non-equal tuning), such as a mapping given by or similar to the examples shown above in Table 1.

In at least some of the conventional approaches known to the inventor the pitch estimation function remains constant. It should be appreciated that the embodiments of this invention enable improved precision when extracting pitch from audio signals that contain, as examples, singing or whistling.

As was noted previously, the use of pitch extraction can enable a user, as a non-limiting example, to compose his or her own ringing tones by singing a melody that is captured, digitized and processed by the system 1, such as a cellular telephone or some other device. The following Table 2 shows the differences "in cents" between an estimated just intonation scale (used by a human a cappella voice) and the equal temperament scale (used by most music synthesizers). It can be noted that because one semi-tone is 100 cents, the largest errors based on this difference are 17.6%

| Interval | Equal Temperament (Hz) | Just Intonation (Hz) | Difference (cents) |
|---|---|---|---|
| Half-step | 1.059463 | 1.066667 | 11.7 |
| Whole step | 1.122462 | 1.125 | 3.91 |
| Minor 3rd | 1.189207 | 1.2 | 15.6 |
| Major 3rd | 1.259921 | 1.25 | −13.7 |
| Perfect 4th | 1.33484 | 1.333333 | −1.96 |
| Augment. 4th | 1.414214 | 1.40625 | −9.78 |
| Perfect 5th | 1.498307 | 1.5 | 1.96 |
| Minor 6th | 1.587401 | 1.6 | 13.7 |
| Major 6th | 1.681793 | 1.666667 | −15.6 |
| Minor 7th | 1.781797 | 1.8 | 17.6 |
| Major 7th | 1.887749 | 1.875 | −11.7 |

The use of the embodiments of this invention permits tuning compensation when there is a constant shift in pitch in the frequency domain, and when lower pitch sounds are in tune but higher pitch sounds are flat (out of tune). The use of the embodiments of this invention makes it possible to extract pitch from non-Western music, as well as from music with a non-traditional tuning. The use of the embodiments of this invention can be applied to pitch extraction with various different input acoustic signal characteristics, such as just intonation, pitch shift in the frequency domain, and non-12-step-equal-temperament tuning.

Referring again to the Ryynänen technique as explained in "Probabilistic Modelling of Note Events in the Transcription of Monophonic Melodies", it can be noted that Ryynänen uses the following technique:

$$x_t = x'_t + c_t, \text{ where } x'_t = 69 + 12\log_2(F_t/440) \text{ (see Equations 3.1 and 3. 10).}$$

After calculating $x'_t$, Ryynäen modifies the value by shifting it with $c_t$, which is produced by a histogram that is updated based on values of $x'_t$. Basically, then, Ryynänen corrects the mistakes of the pitch estimation function by shifting the result of the pitch estimation function by $c_t$.

In the description of the preferred embodiments of this invention the function that produces $x'_t$ is a pitch estimation function. The preferred embodiments of this invention consider cases when this function itself is changed. In other words, the underlying model is changed so that it produces more accurate results, as opposed to simply correcting the results of the model by shifting the results.

The foregoing description has provided by way of exemplary and non-limiting examples a full and informative description of the best method and apparatus presently contemplated by the inventors for carrying out the invention. However, various modifications and adaptations may become apparent to those skilled in the relevant arts in view of the foregoing description, when read in conjunction with the accompanying drawings and the appended claims. As but some examples, the use of other similar or equivalent hardware and systems, and different types of acoustic inputs, may be attempted by those skilled in the art. However, all such and similar modifications of the teachings of this invention will still fall within the scope of the embodiments of this invention.

Furthermore, some of the features of the preferred embodiments of this invention may be used to advantage without the corresponding use of other features. As such, the foregoing description should be considered as merely illustrative of the principles, teachings and embodiments of this invention, and not in limitation thereof.

What is claimed is:

1. A method comprising:

initializing a function $f_t$ and a time t, where t=0, $x'_0=f_0(F_0)$, $x'_0$ is a pitch estimate at time zero and $F_0$ is a frequency of an acoustic signal at time zero; and determining at least one pitch estimate using the function $x'_t=f_t(F_t)$ by an iterative process of creating $f_{t+1}(F_{t+1})$ based at least partly on pitch estimates $x'_t$, $x'_{t-1}$, $x'_{t-2}$, $x_{t-3}$, . . . , and functions $f_t(F_t)$, $f_{t-1}(F_{t-1})$, $f_{t-2}(F_{t-2})$, $f_{t-3}(F_{t-3})$ . . . and incrementing t;

calculating at least one final pitch estimate; and at least one of outputting to an input acoustic transducer, or storing in a memory, the acoustic signal processed in accordance with the at least one final pitch estimate.

2. A method as in claim 1, where $x'_t=f(F_t)$ is represented by $x'_t=m+s*\log_2(F_t/F_b)$, where m is an integer greater than zero, where s defines a number of steps in an octave, and $F_b$ is a reference frequency.

3. A method as in claim 2, and for a case of just intonation, the method further comprising setting s=12, m=a MIDI number of a root note in the key, $F_b=440\times2^{((m-69)/12)}$ Hz, and mapping the ratio $F_t/F_b$ to an adjusted ratio $R_t$.

4. A method as in claim 3, where mapping comprises using a table comprising:

| $F_t/F_b$ | $R_t$ |
|---|---|
| . . . | . . . |
| $2^{(-1)} \times 9/5$ | $2^{(-2)/12}$ |
| $2^{(-1)} \times 15/8$ | $2^{(-1)/12}$ |
| $2^0 \times 1$ | $2^{0/12}$ |
| $2^0 \times 16/15$ | $2^{1/12}$ |
| $2^0 \times 9/8$ | $2^{2/12}$ |
| $2^0 \times 6/5$ | $2^{3/12}$ |
| $2^0 \times 5/4$ | $2^{4/12}$ |
| $2^0 \times 4/3$ | $2^{5/12}$ |
| $2^0 \times 45/32$ | $2^{6/12}$ |
| $2^0 \times 3/2$ | $2^{7/12}$ |
| $2^0 \times 8/5$ | $2^{8/12}$ |
| $2^0 \times 5/3$ | $2^{9/12}$ |
| $2^0 \times 9/5$ | $2^{10/12}$ |
| $2^0 \times 15/8$ | $2^{11/12}$ |
| $2^1 \times 1$ | $2^{12/12}$ |
| $2^1 \times 16/15$ | $2^{13/12}$ |
| $2^1 \times 9/8$ | $2^{14/12}$ |
| $2^1 \times 6/5$ | $2^{15/12}$ |
| $2^1 \times 5/4$ | $2^{16/12}$ |
| $2^1 \times 4/3$ | $2^{17/12}$ |
| . . . | . . . . |

5. A method as in claim 2, further comprising, subsequent to calculating multiple final pitch estimates $x_{t,i}$ of a first note: setting $m=x_t$ where $x_t$ depends on all $x_{t,i}$ and modifying $F_b$ to be a corresponding frequency;

continuing the iterative process; and mapping the ratio $F_t/F_b$ to an adjusted ratio $R_t$ for each note according to:

| $F_t/F_b$ | $R_t$ |
|---|---|
| . . . | . . . |
| $2^{(-1)} \times 9/5$ | $2^{(-2)/12}$ |
| $2^{(-1)} \times 15/8$ | $2^{(-1)/12}$ |
| $2^0 \times 1$ | $2^{0/12}$ |
| $2^0 \times 16/15$ | $2^{1/12}$ |
| $2^0 \times 9/8$ | $2^{2/12}$ |
| $2^0 \times 6/5$ | $2^{3/12}$ |
| $2^0 \times 5/4$ | $2^{4/12}$ |
| $2^0 \times 4/3$ | $2^{5/12}$ |
| $2^0 \times 45/32$ | $2^{6/12}$ |
| $2^0 \times 3/2$ | $2^{7/12}$ |
| $2^0 \times 8/5$ | $2^{8/12}$ |
| $2^0 \times 5/3$ | $2^{9/12}$ |
| $2^0 \times 9/5$ | $2^{10/12}$ |
| $2^0 \times 15/8$ | $2^{11/12}$ |
| $2^1 \times 1$ | $2^{12/12}$ |
| $2^1 \times 16/15$ | $2^{13/12}$ |
| $2^1 \times 9/8$ | $2^{14/12}$ |
| $2^1 \times 6/5$ | $2^{15/12}$ |
| $2^1 \times 5/4$ | $2^{16/12}$ |
| $2^1 \times 4/3$ | $2^{17/12}$ |
| . . . | . . . . |

6. A method as in claim 5, where during the iterative process initial pitch estimates are computed as $x'_t=m+s*\log_2(R_t)$.

7. A method as in claim 1, where $x'_t=m+s*\log_2(R_t)$, where m is an integer greater than 0, where s=12 and $R_t=(F_t+(\text{delta}))/F_b$ to accommodate a shift in pitch, where delta is defined as a constant error, where s defines a number of steps in one octave, and where $R_t$ is a ratio that depends on $F_b$ and $F_t$.

8. A method as in claim 1, where $x'_t=m+s*\log_2(F_t/F_b)$, where s=(alpha)*12, where the value of (alpha) defines by how much a musical scale is contracted or expanded, where m is an integer greater than zero, where $F_b$ is a reference frequency and where values of m and $F_b$ are selected to be from a range of pitch frequencies that are known to be in tune.

9. A method as in claim 1, where $x'_t=s*\log_2(R_t)$, where $R_t$ is a ratio that depends on $F_t$ and $F_b$, and where s defines a number of steps in one octave.

10. A method as in claim 9, where $R_t=F_t/F_b$ for a case of equal tuning.

11. A method as in claim 9, where $R_t$ represents a mapping of $F_t/F_b$ for a case of non-equal tuning.

12. A computer-readable storage medium as in claim 3, the method further comprising setting s=12, m=a MIDI number of a root note in the key, $F_b=440\times2^{((m-69)/12)}$ Hz, and mapping the ratio $F_t/F_b$ to an adjusted ratio $R_t$.

13. A computer-readable storage medium as in claim 12, where mapping comprises using a table comprising:

| $F_t/F_b$ | $R_t$ |
|---|---|
| . . . | . . . |
| $2^{(-1)}\times 9/5$ | $2^{(-2)/12}$ |
| $2^{(-1)}\times 15/8$ | $2^{(-1)/12}$ |
| $2^0\times 1$ | $2^{0/12}$ |
| $2^0\times 16/15$ | $2^{1/12}$ |
| $2^0\times 9/8$ | $2^{2/12}$ |
| $2^0\times 6/5$ | $2^{3/12}$ |
| $2^0\times 5/4$ | $2^{4/12}$ |
| $2^0\times 4/3$ | $2^{5/12}$ |
| $2^0\times 45/32$ | $2^{6/12}$ |
| $2^0\times 3/2$ | $2^{7/12}$ |
| $2^0\times 8/5$ | $2^{8/12}$ |
| $2^0\times 5/3$ | $2^{9/12}$ |
| $2^0\times 9/5$ | $2^{10/12}$ |
| $2^0\times 15/8$ | $2^{11/12}$ |
| $2^1\times 1$ | $2^{12/12}$ |
| $2^1\times 16/15$ | $2^{13/12}$ |
| $2^1\times 9/8$ | $2^{14/12}$ |
| $2^1\times 6/5$ | $2^{15/12}$ |
| $2^1\times 5/4$ | $2^{16/12}$ |
| $2^1\times 4/3$ | $2^{17/12}$ |
| . . . | . . . . |

14. A computer-readable storage medium storing a computer program for causing the computer to perform operations that comprise:

initializing a function $f_t$ and a time t, where t=0, $x'_0=f_0(F_0)$, $x'_0$ is a pitch estimate at time zero and $F_0$ is a frequency of the acoustic signal at time zero;

determining at least one pitch estimate using the function $x'_t=f_t(F_t)$ by an iterative process of creating $f_{t+1}(F_{t+1})$ based at least partly on pitch estimates $x'_t$, $x'_{t-1}$, $x_{t-2}$, $x_{t-3}$, . . . , and functions $f_t(F_t)$, $f_{t-1}(F_{t-1})$, $f_{t-2}(F_{t-2})$, $f_{t-3}(F_{t-3})$ . . . and incrementing t; calculating at least one final pitch estimate; and at least one of outputting to an input acoustic transducer, or storing in a memory, the acoustic signal processed in accordance with the at least one final pitch estimate.

15. A computer-readable storage medium as in claim 14, where $x'_t=f(F_t)$ is represented by $x'_t=m+s*\log_2(F_t/F_b)$, where m is an integer greater than zero, where s defines a number of notes in an octave, and $F_b$ is a reference frequency.

16. A computer-readable storage medium as in claim 15, further comprising, subsequent to calculating multiple final pitch estimates $x_{t,i}$ of a first note:

setting $m=x_t$, where $x_t$ depends on all $x_{t,i}$, and modifying $F_b$ to be a corresponding frequency;

continuing the iterative process; and mapping the ratio $F_t/F_b$ to an adjusted ratio $R_t$ for each note according to:

| $F_t/F_b$ | $R_t$ |
|---|---|
| . . . | . . . |
| $2^{(-1)}\times 9/5$ | $2^{(-2)/12}$ |
| $2^{(-1)}\times 15/8$ | $2^{(-1)/12}$ |
| $2^0\times 1$ | $2^{0/12}$ |
| $2^0\times 16/15$ | $2^{1/12}$ |
| $2^0\times 9/8$ | $2^{2/12}$ |
| $2^0\times 6/5$ | $2^{3/12}$ |
| $2^0\times 5/4$ | $2^{4/12}$ |
| $2^0\times 4/3$ | $2^{5/12}$ |
| $2^0\times 45/32$ | $2^{6/12}$ |
| $2^0\times 3/2$ | $2^{7/12}$ |
| $2^0\times 8/5$ | $2^{8/12}$ |
| $2^0\times 5/3$ | $2^{9/12}$ |
| $2^0\times 9/5$ | $2^{10/12}$ |
| $2^0\times 15/8$ | $2^{11/12}$ |
| $2^1\times 1$ | $2^{12/12}$ |
| $2^1\times 16/15$ | $2^{13/12}$ |
| $2^1\times 9/8$ | $2^{14/12}$ |
| $2^1\times 6/5$ | $2^{15/12}$ |
| $2^1\times 5/4$ | $2^{16/12}$ |
| $2^1\times 4/3$ | $2^{17/12}$ |
| . . . | . . . . |

17. A computer-readable storage medium as in claim 16, where during the iterative process initial pitch estimates are computed as $x'_t=m+s*\log_2(R_t)$.

18. A computer-readable storage medium as in claim 14, where $x'_t=m+s*\log_2(R_t)$, where s=12 and $R_t=(F_t+(\text{delta}))/F_b$ to accommodate a shift in pitch, where delta is defined as a constant error, where s defines a number of steps in one octave, where $R_t$ is a ratio that depends on $F_b$ and $F_t$, and where m is an integer greater than zero.

19. A computer-readable storage medium as in claim 14, where $x'_t=m+s*\log_2(F_t/F_b)$, where s=(alpha)*12, where the value of (alpha) defines by how much a musical scale is contracted or expanded, where m is an integer greater than zero where $F_b$ is a reference frequency and where values of m and $F_b$ are selected to be from a range of pitch frequencies that are known to be in tune.

20. A computer-readable storage medium as in claim 14, where $x'_t=s*\log_2(R_t)$, where $R_t$ is a ratio that depends on $F_t$ and $F_b$, and where s defines a number of steps in one octave.

21. A computer-readable storage medium as in claim 20, where $R_t=F_t/F_b$ for a case of equal tuning.

22. A computer-readable storage medium as in claim 20, where $R_t$=is set equal to a mapping of $F_t/F_b$ for a case of non-equal tuning.

23. A system comprising:

an input to receive data representing an acoustic signal; and a processor to process the received data to estimate a pitch of the acoustic signal, where said processor comprises:

means for initializing a function $f_t$, and a time t, where t=0, $x'_0=f_0(F_0)$, $x'_0$ is a pitch estimate at time zero and $F_0$ is a frequency of the acoustic signal at time zero;

means for determining at least one pitch estimate using the function $x'_t=f_t(F_t)$ by an iterative process of creating $f_{t+1}(F_{t+1})$ based at least partly on pitch estimates $x'_t$, $x'_{t-1}$, $x'_{t-2}$, $x'_{t-3}$, . . . , and functions $f_t(F_t)$, $f_{t-1}(F_{t-1})$, $f_{t-2}(F_{t-2})$, $f_{t-3}(F_{t-3})$ . . . and incrementing t; and means for determining at least one final pitch estimate ($x_t$); wherein the system further comprises at least one of:

an output acoustic transducer coupled to the processor to output the acoustic signal processed in accordance with the at least one final pitch estimate; and at least one memory coupled to the processor for storing the acoustic signal processed in accordance with the at least one final pitch estimate.

24. A system as in claim 23, where the input to receive data is coupled to a data communications network.

25. A system as in claim 23, where the input to receive data comprises an input acoustic transducer and an analog to digital conversion means for converting an acoustic signal to data that represents the acoustic signal.

26. A system as in claim 23, where the acoustic signal comprises a person's voice.

27. A system as in claim 26, where the system comprises a telephone, where the processor uses the at least one final pitch estimate for generating a ringing tone.

28. A system as in claim 23, where determining the final pitch estimate ($x_t$) determines a final pitch estimate of a single note from multiple pitch estimates ($x_{t,i}$) that have been determined for the same note.

29. A system as in claim 28, where at least for a case of a loss of a sense of key, the final pitch estimate, which depends on all $x_{t,i}$, is determined for a note before a recursion may continue for a next note with a slightly or clearly different key.

30. A system as in claim 28, where determining final pitch estimate comprises a shifting operation that adds a histogram mass center $c_t$ to a result of the pitch estimation.

* * * * *